US011572858B2

(12) United States Patent
Leblay et al.

(10) Patent No.: US 11,572,858 B2
(45) Date of Patent: Feb. 7, 2023

(54) POLE PIECE RETENTION AND INSERTION METHOD

(71) Applicant: DELPHI AUTOMOTIVE SYSTEMS LUXEMBOURG SA, Bascharage (LU)

(72) Inventors: Arnaud Leblay, Beuveille (FR); Cas Breedijk, Kanfen (FR)

(73) Assignee: DELPHI AUTOMOTIVE SYSTEMS LUXEMBOURG SA, Bascharage (LU)

( * ) Notice: Subject to any disclaimer, the term of this patent is extended or adjusted under 35 U.S.C. 154(b) by 0 days.

(21) Appl. No.: 17/275,488

(22) PCT Filed: Sep. 10, 2019

(86) PCT No.: PCT/EP2019/074045

§ 371 (c)(1),
(2) Date: Mar. 11, 2021

(87) PCT Pub. No.: WO2020/053181

PCT Pub. Date: Mar. 19, 2020

(65) Prior Publication Data

US 2022/0120248 A1 Apr. 21, 2022

(30) Foreign Application Priority Data

Sep. 12, 2018 (GB) ..... 1814825

(51) Int. Cl.
*F02M 69/04* (2006.01)
*F02M 61/16* (2006.01)
*F02M 63/00* (2006.01)

(52) U.S. Cl.
CPC ..... *F02M 61/168* (2013.01); *F02M 63/0007* (2013.01); *F02M 2200/8084* (2013.01)

(58) Field of Classification Search
CPC ..... F02M 51/0682; F02M 51/0671; F02M 51/0614; B23K 26/244; H01F 7/08
USPC ..... 123/445
See application file for complete search history.

(56) References Cited

U.S. PATENT DOCUMENTS

| | | | | |
|---|---|---|---|---|
| 5,330,153 | A | 7/1994 | Reiter | |
| 6,244,526 | B1 | 6/2001 | Schuldt et al. | |
| 6,708,906 | B2 * | 3/2004 | Dallmeyer | F02M 51/0682 239/585.4 |
| 6,834,667 | B2 * | 12/2004 | Sumiya | F02M 51/0671 29/888.41 |
| 7,093,362 | B2 * | 8/2006 | Dallmeyer | F02M 61/168 239/585.4 |
| 7,617,605 | B2 * | 11/2009 | Fochtman | B23K 26/244 228/141.1 |

(Continued)

FOREIGN PATENT DOCUMENTS

WO 2015074927 A1 5/2015

*Primary Examiner* — Long T Tran
*Assistant Examiner* — James J Kim
(74) *Attorney, Agent, or Firm* — Warner Norcross + Judd LLP

(57) ABSTRACT

A fuel injector includes an injector body which accommodates a pole piece of a solenoid actuator. A top portion of the injector body includes a cylindrically formed generally open-ended recessed portion. The recessed portions accommodates a generally cylindrical pole piece, wherein the pole piece includes a bore located along a central axis to provide a fuel flow path. The top portion of the pole piece includes a cylindrically formed recess so as to form a sleeve or lip portion.

6 Claims, 2 Drawing Sheets

(56) References Cited

U.S. PATENT DOCUMENTS

| | | | | |
|---|---|---|---|---|
| 2007/0107699 | A1 | 5/2007 | Fochtman et al. | |
| 2008/0290195 | A1* | 11/2008 | Imoehl | F02M 61/168 239/533.9 |
| 2009/0144982 | A1* | 6/2009 | Miller | B05B 1/302 29/890.12 |
| 2015/0167610 | A1* | 6/2015 | Fujita | F02M 65/001 239/584 |
| 2015/0285199 | A1* | 10/2015 | Vorbach | F02M 51/061 239/585.5 |

* cited by examiner

POLE PIECE RETENTION AND INSERTION METHOD

CROSS REFERENCE TO RELATED APPLICATIONS

This application is a national stage application under 35 USC 371 of PCT Application No. PCT/EP2019/074045 having an international filing date of Sep. 10, 2019, which is designated in the United States and which claimed the benefit of GB Patent Application No. 1814825.4 filed on Sep. 12, 2018, the entire disclosures of each are hereby incorporated by reference in their entirety.

TECHNICAL FIELD

This invention relates to fuel injectors and particularly to a pole piece for a fuel injector. It also relates to a method of inserting and fixing a pole piece into a fuel passage of an injector body.

BACKGROUND OF THE INVENTION

Typically pole pieces of fuel injectors are press fitted into a recess (providing a fuel passage) in an injector body. One development path to improve (e.g. gasoline engine) fuel injector performance is to increase the system pressure in fuel injectors. This requires high structural resistance of the injector pressure vessel and as well as structural integrity for the retention of the pole piece which is maintained in position by a press-fit.

This press-fit decreases with the increase of the internal pressure. The interference area of the press-fit cannot be increased more since the insertion force and the material strength limits are finite. The insertion force of the pole piece into the injector body has to be limited, and pole piece retention has to be ensured under pressure with a material with weaker mechanical properties but with higher magnetic performance.

Any welding process to assembly the pole piece to the upper housing generates the weakest point of the injector in regards to the internal pressure.

It is an object of the invention to provide a design and method of pole piece retention which allows increased pressure application and which also overcomes the aforementioned problems.

SUMMARY OF THE INVENTION

In one aspect is provided A fuel injector including an injector body adapted to accommodate a pole piece of a solenoid actuator, where the top portion of said injector body includes a cylindrically formed generally open-ended recessed portion, said recessed portions accommodating a generally cylindrical pole piece, wherein said pole piece includes a bore located along the central axis to provide a fuel flow path, and the top portion of said pole piece includes a cylindrically formed recess so as to form a sleeve or lip portion.

A distal portion of said lip or sleeve portion may protrude from the top end of the injector body.

The fuel injector may including upper housing, the distal end of which is in contact with the upper end of the injector body and a distal portion of said lip or sleeve portion.

The fuel injector may include a weld formed at the junction of distal end of the upper housing, with the upper end of the injector body and a distal portion of said lip or sleeve portion.

Said weld may join at least three of the following: distal end of the upper housing, upper end of the injector body and a distal portion of said lip or sleeve portion.

The outer diameter (OD) of the pole piece sleeve(and inner diameter (ID) of the pole piece sleeve may be dimensioned such that:

$$0.1 < \frac{L}{OD} < 0.5$$

The length (thickness) of the lip (L) and the pole piece sleeve outer diameter OD may be dimensioned such that:

$$0.1 < \frac{L}{OD} < 0.5$$

BRIEF DESCRIPTION OF THE DRAWINGS

Preferred The present invention is now described by way of example with reference to the accompanying drawings in which.

DESCRIPTION OF THE PREFERRED EMBODIMENTS

Figure 1:
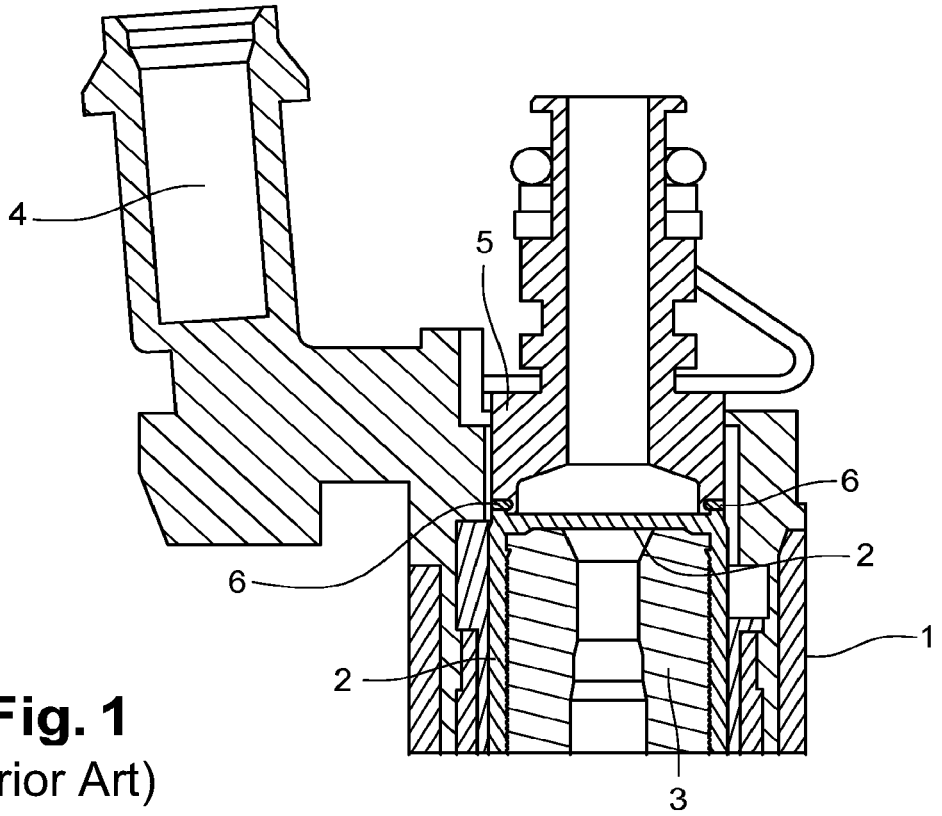
Fig. 1 (Prior Art)
FIG. 1 shows a current known design showing the schematically the top portion of a solenoid operated fuel injector.

FIG. 1 shows a current known design showing the schematically the top portion of a solenoid operated fuel injector.

An injector outer housing 1 contains an injector body 2. The injector body is in the form of a generally hollow cylindrical housing has generally a closed upper end and contains the pole piece. The pole piece 3 comprises a generally cylindrical body and along the longitudinal central axis thereof is formed a fuel flow channel i.e. an internal fuel passage. An electrical connector piece 4 provides electrical connection and terminals. An upper housing 5 is fitted onto the arrangement as shown.

The welding 6 is performed around/at the bottom (rim) portion and the top of the injector body after the pole piece is press fitted.

Figure 2:
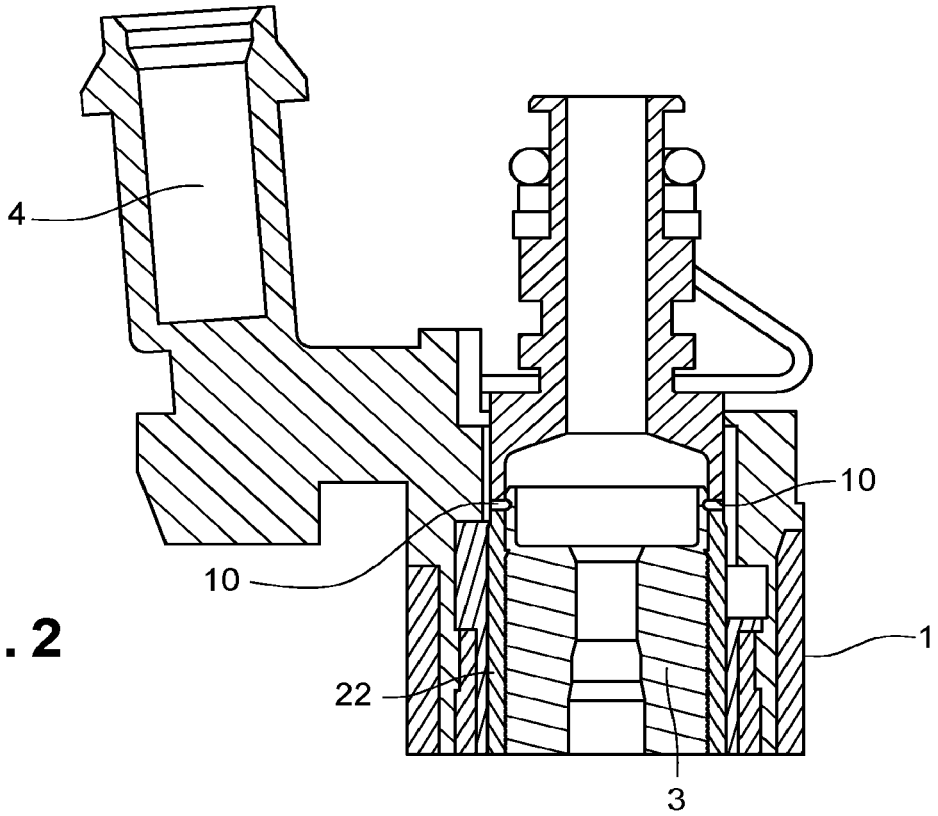
FIG. 2 shows an arrangement according to one aspect.

FIG. 2 shows an arrangement according to one aspect which shows the pole piece/upper housing/injector body assembly. The same components have generally the same components as FIG. 1. Here the injector body 22 is formed open ended at the top. The pole piece 3 is fitted i.e. inserted into this open end. The weld portion has reference numeral 10.

Figure 3:
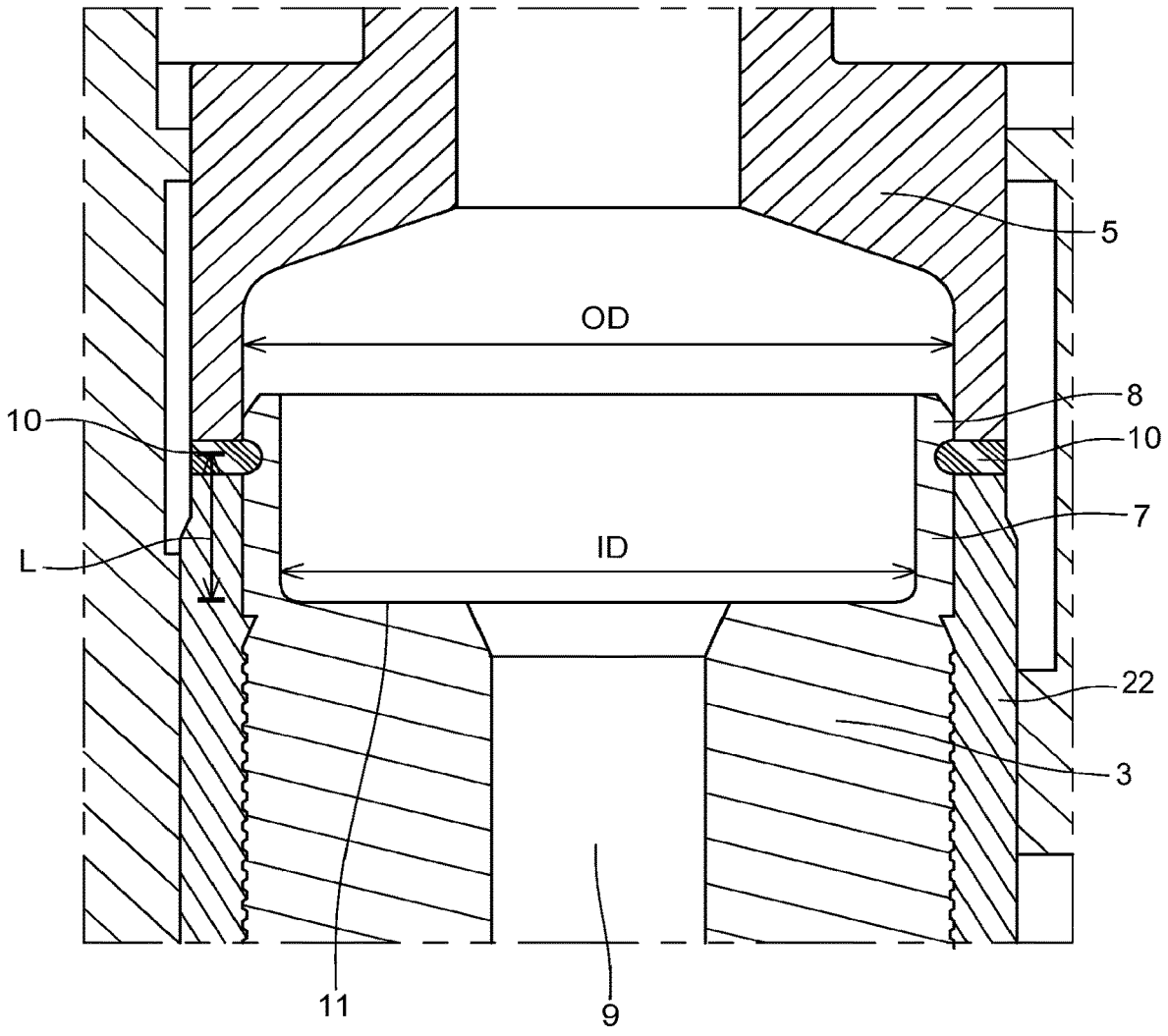
FIG. 3 shows the salient portion of FIG. 2 in more detail.

FIG. 3 shows the salient portion in more detail.

The pole piece at the upper end has a sleeved portion 7 defining a circumferential rim or lip portion 8. At the bottom of the recess the fluid passage 9 is provided, and so a shoulder portion is formed.

The pole piece sleeve forming the relatively long thin (circumferential) lip provides two functions: It is used as a backup lip for the welding to prevent weld splatters and by appropriate dimensioning, stresses are minimized in the area improving significantly the pressure strength of the injector pressure vessel, formed by the injector body and arrangement shown.

Welding is performed through the upper housing and the injector body and partially through the pole piece maintaining the three components in a tight assembly. The weld region is shown with reference numeral 10.

The inner diameter of the sleeve (ID) must be as close as possible to the outer diameter (OD) to prevent high difference of area. The lip length L must be sufficient to allow a "smooth stiffness transition" between the assemble components.

The arrangement provides a decrease of the stress of the assembly under pressure while ensuring the retention of the pole piece through the weld.

Preferably the range of the parameters can be defined as follow:

$$0.7 < \frac{ID}{OD} < 0.99$$

$$0.1 < \frac{L}{OD} < 0.5$$

Where OD is the pole piece outer diameter, ID is the pole piece inner diameter, and L is the lip length defined between the center of the weld and the flat surface 11 of the pole piece.

The invention claimed is:

1. A fuel injector comprising:

an upper housing; and an injector body which accommodates a cylindrical pole piece, where a top portion of said injector body includes a cylindrically formed open-ended recessed portion, said recessed portion accommodating the cylindrical pole piece, wherein said cylindrical pole piece includes a bore located along a central axis which provides a fuel flow path and a top portion of said cylindrical pole piece includes a cylindrically formed recess so as to form a sleeve including a lip portion; wherein a weld is formed at a junction of a distal end of the upper housing, an upper end of the injector body, and a distal portion of said sleeve.

2. A fuel injector as claimed in claim 1, wherein the distal portion of said sleeve including said lip portion extends beyond a top end of the injector body.

3. A fuel injector as claimed in claim 1, wherein the distal end of the upper housing and the upper end of the injector body are each in contact with the distal portion of said sleeve.

4. A fuel injector as claimed in claim 1, wherein said weld joins at least two of the following: the distal end of the upper housing, the upper end of the injector body, and the distal portion of said lip or sleeve portion.

5. A fuel injector as claimed in claim 1, wherein an outer diameter (OD) of the sleeve or lip portion and an inner diameter (ID) of the sleeve or lip portion are dimensioned such that:

$$0.7 < \frac{ID}{OD} < 0.99.$$

6. A fuel injector as claimed in claim 1, wherein a thickness (L) of the sleeve or lip portion and an outer diameter (OD) of the sleeve or lip portion are dimensioned such that:

$$0.1 < \frac{L}{OD} < 0.5.$$

* * * * *